US006845739B2

(12) United States Patent
Nakamizo et al.

(10) Patent No.: US 6,845,739 B2
(45) Date of Patent: Jan. 25, 2005

(54) SMALL-SIZE ENGINE WITH FORCED AIR COOLING SYSTEM

(75) Inventors: Keiichi Nakamizo, Hyogo (JP); Koji Takahashi, Akashi (JP); Yukio Miki, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/368,189

(22) Filed: Feb. 18, 2003

(65) Prior Publication Data

US 2003/0154934 A1 Aug. 21, 2003

(30) Foreign Application Priority Data

Feb. 20, 2002 (JP) ..... 2002-042828

(51) Int. Cl.[7] ..... F01D 11/00
(52) U.S. Cl. ..... 123/41.56; 123/198 E
(58) Field of Search ..... 123/41.56, 198 E, 123/41.7

(56) References Cited

U.S. PATENT DOCUMENTS 4,261,302 A * 4/1981 Sheldon ..... 123/41.7
4,548,167 A * 10/1985 Tamba et al. ..... 123/41.56
4,692,123 A * 9/1987 Tada et al. ..... 440/77
4,907,546 A * 3/1990 Ishii et al. ..... 123/41.56
5,960,751 A * 10/1999 Isoshima ..... 123/58.1
6,227,162 B1 * 5/2001 Dahlberg et al. ..... 123/198 E
6,378,467 B1 * 4/2002 Kobayashi et al. ..... 123/41.56
6,378,469 B1 * 4/2002 Hiranuma et al. ..... 123/41.56

FOREIGN PATENT DOCUMENTS

JP 10-227214 8/1998

* cited by examiner

*Primary Examiner*—Henry C. Yuen
*Assistant Examiner*—Jason Benton

(57) ABSTRACT

To provide a small-size engine having a forced air cooling system, wherein the amount of protrusion of the air intake system outwardly from the engine body can be minimized and the limitation on the space required for installation of the engine to the various work units can be alleviated, the engine includes a cooling fan (9) mounted on one end of a crankshaft (4) and has a longitudinal axis (S) of a cylinder block (5) inclined relative to a horizontal direction and also to a vertical direction. A fan housing (17) for guiding a cooling air (W) from the cooling fan (9) towards a cylinder block (5) and a cylinder head (6) is formed with a cutout (22) through which a float chamber (23) of a carburetor (15) is positioned inside the fan housing (17).

13 Claims, 5 Drawing Sheets

SMALL-SIZE ENGINE WITH FORCED AIR COOLING SYSTEM

BACKGROUND OF THE INVENTION

1. Field of the Invention

The present invention relates to a small-size engine having a forced air cooling system for cooling a cylinder block and a cylinder head with a cooling air induced by a cooling fan.

2. Description of the Prior Art

A small-size engine having a forced air cooling system is known in which a cylinder block of an engine body has a longitudinal axis inclined relative to a horizontal direction and also to a vertical direction, and in which a fan housing is provided on one side of the engine body to cover a cooling fan mounted on one end of a crankshaft so that a cooling air induced by the cooling fan can be guided through the fan housing towards the cylinder block and a cylinder head of the engine body. In such arrangement, an air cleaner and a carburetor defining an air intake passage of the engine are mounted so as to protrude outwardly of the fan housing to secure a cooling air passage within the fan housing. See, for example, the Japanese Laid-open Patent Publication No. 10-227214. In this engine, in order to avoid interference between the carburetor and an ignition unit that is disposed at a location level with the carburetor and offset from the carburetor towards a longitudinal axis of a crankshaft, the air cleaner and the carburetor are so disposed as to protrude diagonally outwardly relative to the longitudinal axis of the crankshaft to thereby separate them away from the longitudinal axis of the crankshaft.

However, it has been found that since in the engine of the structure described above the air cleaner and the carburetor protrude a substantial amount outwardly from the engine body, the space required for an installation of the engine to various work units has been limited. Also, the engine operation tends to be irregular when the carburetor is strongly affected by an external heat, for example, radiant heat generated from the work unit.

SUMMARY OF THE INVENTION

In view of the foregoing, the present invention has for its object to provide a small-size engine having a forced air cooling system, wherein an amount of protrusion of an air intake system of the engine outwardly from the engine body can be minimized and a limitation on a space required for various work units to be mounted on the engine body can be alleviated.

In order to accomplish this object, the present invention provides a small-size engine having a forced air cooling system, including a cooling fan mounted on one end of a crankshaft and a longitudinal axis of a cylinder body inclined relative to a horizontal direction and also to a vertical direction. This engine includes a cylinder head mounted atop the cylinder block, and a fan housing for guiding a cooling air, induced by the cooling fan, towards the cylinder block and the cylinder head, a carburetor including a float chamber. The fan housing has a cutout defined therein, and the float chamber of the carburetor is positioned inside the fan housing through the cutout.

According to such a structure, since the float chamber of the carburetor is positioned within the fan housing through the cutout defined in the fan housing, the carburetor can be positioned at a location close to the engine body as compared with the design in which the carburetor in its entirety is positioned outside the fan housing and, therefore, an amount of protrusion of the carburetor outwardly of the engine body can be reduced, making it possible to assemble the engine in a compact size. Consequently, limitations on a space available for installing the engine to various work units can be minimized correspondingly. Also, since the float chamber is effectively and sufficiently cooled by the cooling air guided thereto through a cooling air passage defined by the fan housing, it is possible to avoid the irregularity of the engine operation which would result from influences brought about by external heat, for example, heat from the work unit.

In a preferred embodiment, the engine also includes an ignition unit for driving an ignition plug. This ignition unit is preferably positioned within the fan housing at a location below the carburetor.

Disposition of the ignition unit within the fan housing at a location below the carburetor allows the ignition unit to be positioned at a location in the vicinity of the cylinder head, that is, the ignition plug without interfering the carburetor while securing a sufficient cooling capability.

In another preferred embodiment, the float chamber is positioned in a cooling air passage, defined in the fan housing, at a location upstream of the cylinder block and the cylinder head.

With the float chamber so positioned, the float chamber can be effectively cooled by the cooling air of a low temperature before the cylinder block and the cylinder head are cooled thereby.

In a further preferred embodiment, the engine also includes an air cleaner fluid coupled with an upstream portion of the carburetor in an air intake passage of the engine. This air cleaner is preferably positioned outside the fan housing. According to this feature, an undesirable increase in temperature of the air cleaner which would result from the radiant heat from the cylinder block and the cylinder head can be prevented advantageously.

In a further preferred embodiment, the engine, furthermore includes a drain discharge operating member, an idling setting member, a pilot setting member and/or an air vent passage, for the carburetor and at least one of them is positioned outside the fan housing. According to this feature, adjustment and servicing of those members can easily be performed from outside the fan housing.

According to another aspect of the present invention, the present invention also provides a small-size engine having a forced air cooling system, including a crankshaft having a longitudinal axis and a cooling fan mounted on one end of the crankshaft and a longitudinal axis of a cylinder body inclined relative to a horizontal direction and also to a vertical direction so as to be diagonally upwardly oriented, which engine includes an air intake passage; a fuel supply device; an air cleaner fluid coupled with an upstream portion of the fuel supply device in the air intake passage; and an ignition unit for driving an ignition plug of the engine. A major portion of the air intake passage ranging at least from the air cleaner to a downstream end of the fuel supply device extends parallel to the longitudinal axis of the crankshaft, and the ignition unit is disposed below the fuel supply device.

According to such a structure, since the major portion of the air intake passage is so disposed as to extend parallel to the longitudinal axis of the crankshaft, the amount of respective portions of the air cleaner and the fuel supply device that protrude laterally and rearwardly from the engine body can be advantageously reduced and, therefore, the engine can be assembled compact. As a result thereof, the limitation on the space available for installation of the engine to the various work units can be alleviated. Yet, since the ignition unit for driving the ignition plug is positioned below the fuel supply device, the fuel supply device and the ignition unit do not interfere with each other. It is to be noted that the fuel supply device referred to above may be a carburetor or a fuel injection device.

In a preferred embodiment of the second aspect of the present invention, the engine further includes a fan housing for guiding a cooling air from the cooling fan towards the cylinder block and the cylinder head, and the fuel supply device referred to above may be a carburetor having a float chamber, and the fan housing is formed with a cutout through which the float chamber of the carburetor is positioned inside the fan housing.

According to the above described construction, the cooling air guided through a cooling air passage formed by the fan housing can cool the float chamber satisfactorily and, therefore, the possibility of the engine operation being irregular under the influence of an external heat can be avoided.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

With reference to accompanying drawings, a preferred embodiment of the present invention will now be described.

Figure 1:
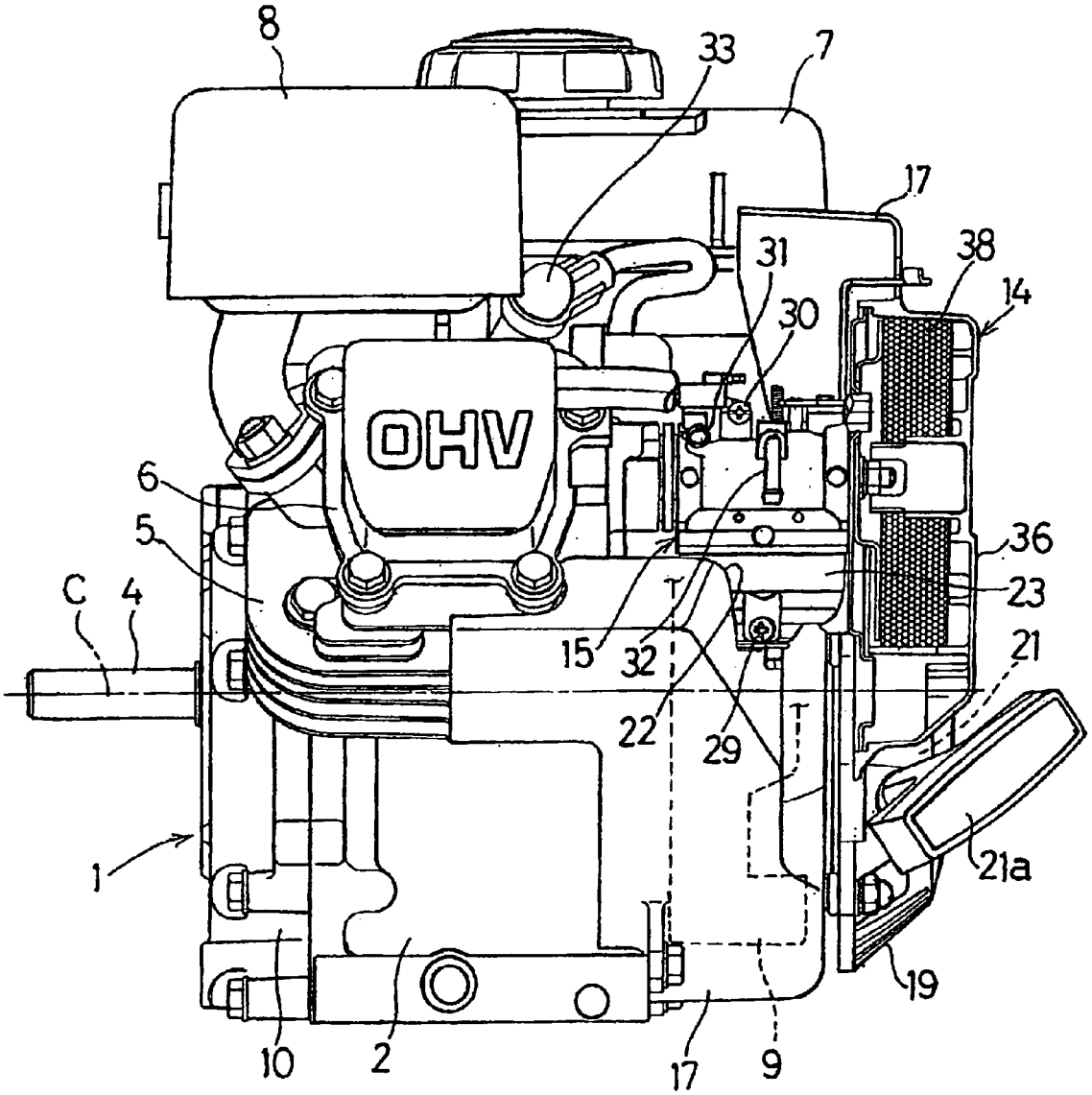
FIG. 1 is a side view, with a portion cut out, showing a small-size engine having a forced air cooling system in accordance with a preferred embodiment of the present invention.
Figure 3:
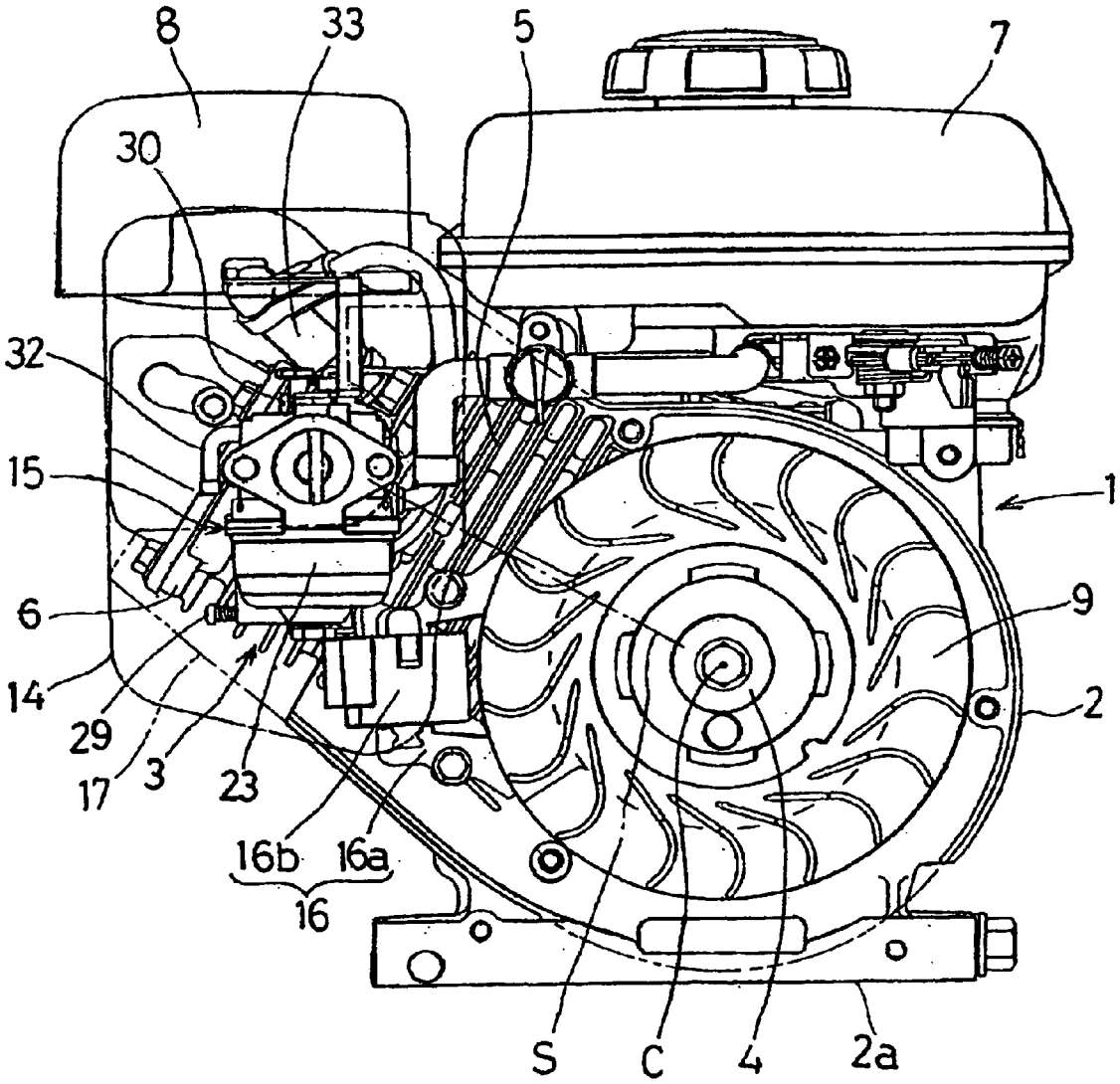
FIG. 3 is a rear view of the small-size engine shown in FIG. 1, with a fan housing and an air cleaner removed.

A small-size engine shown in FIG. 1 is a four cycle, overhead valve engine having a forced air cooling system, that can be utilized as a drive source for various work units such as a compact electric power generator and a water pump. The illustrated engine includes an engine body 1 having a crankcase 2, a cylinder block 5 having a cylinder bore and formed integrally with the crankcase 2, and a cylinder head 6 mounted atop the cylinder block 5. A crankshaft 4 is rotatably supported within and by the crankcase 2. The crankcase 2 has a front opening that is closed by a side cover 10. As best shown in FIG. 3, the cylinder block 5 or the cylinder bore has its longitudinal axis S and is so arranged and so oriented that the longitudinal axis S inclines relative to a horizontal direction and also to a vertical direction and, hence, the cylinder block 5 is diagonally upwardly oriented. A piston (not shown) is drivingly coupled with the crankshaft 4 through a connecting rod (also not shown) and is accommodated within the cylinder bore defined in the cylinder block 5. As is well known to those skilled in the art, a fuel tank 7 is provided above the crankcase 2; an exhaust muffler 8 is provided above the cylinder head 6; and an ignition plug 33 is provided upwardly on the cylinder head 6.

A cooling fan 9 is fixedly mounted on one end of the crankshaft 4 that is located on a rear side of the engine body 1, that is, a right-hand end of the crankshaft 4 as viewed in FIG. 1, for rotation together with the crankshaft 4. The other end of the crankshaft 4, that is, a left-hand end of the crankshaft 4 as viewed in FIG. 1 serves as an output end and is connected with the work units such as the compact electric power generator and the water pump. As schematically shown in a plan view in FIG. 5, a rear surface of the cylinder head 6 of the engine body 1 is provided with an air cleaner 14 and a fuel supply device 15 fluid connected thereto in this order from a rear side (underside. in FIG. 5) towards a front side (upperside in FIG. 5) with a downstream end of the fuel supply device 15 coupled with an air intake port 11 in the cylinder head 6. The air cleaner 14 and the fuel supply device 15 form an air intake system 12 of the engine. Since the longitudinal axis S of the cylinder block 5 is inclined as hereinabove described, the air intake system 12 fluid connected with the cylinder head 6 is, when viewed in a plane view, positioned at a location offset relative to a longitudinal axis C of the crankshaft 4. A major portion 13*a* ranging from the air cleaner 14 to the downstream end of the fuel supply device 15 in an air intake passage 13 is so disposed as to be parallel to the longitudinal axis C of the crankshaft 4. In this embodiment, the fuel supply device 15 is comprised of a carburetor.

Also as shown in FIG. 3, an ignition unit 16 for driving an ignition plug 33 of the engine is disposed within a fan housing 17, as will be described hereinafter, at a location below the fuel supply unit 15. This ignition unit 16 includes a core 16*a* made of a magnetic material and disposed in face-to-face relation with a magnet (not shown) carried by the cooling fan 9 that concurrently serves as a flywheel, and a molded unit body 16*b* enclosing an ignition circuit including an ignition coil wound around the magnetic core 16*a*. The ignition unit 16 has conventionally been positioned diagonally upwardly of the cooling fan 9 (generally at a location overlapping the cylinder longitudinal axis S as viewed from a direction of the longitudinal axis C of the crankshaft 4), but in accordance with the illustrated embodiment, the ignition unit 16 is disposed at a location lower than that and, specifically, at a location laterally of the cooling fan 9. More specifically, a position of the ignition unit 16 in a direction of the height of the engine above a bottom surface 2*a* of the crankcase 2, that is, a support surface of the engine in this embodiment, is so chosen as to be substantially level with the axis of rotation of the cooling fan 9, that is, the longitudinal axis C of the crankshaft 4. Accordingly, the position of the ignition unit 16 does not interfere with the fuel supply device 15.

Figure 5:
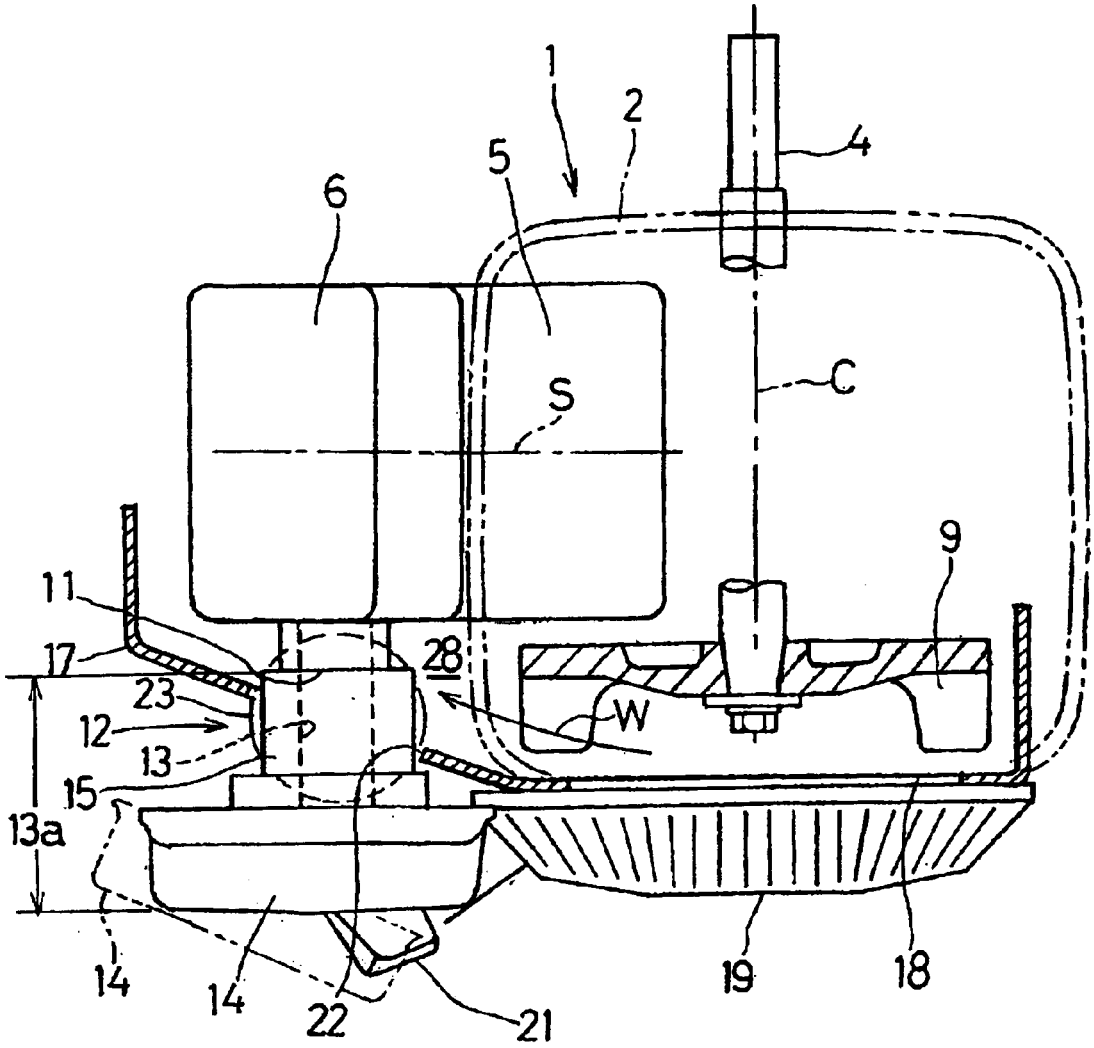
FIG. 5 is a plan view of the small-size engine, showing the position of the air cleaner and the fuel supply device relative to a crankshaft.

The fan housing 17 for guiding a cooling air W from the cooling fan 9 towards the cylinder block 5 and the cylinder head 6 is fitted to a rear side surface of the engine body 1 as shown in FIG. 5. A portion of this fan housing 17 confronting the cooling fan 9 is formed with a suction opening 18.

Figure 2:
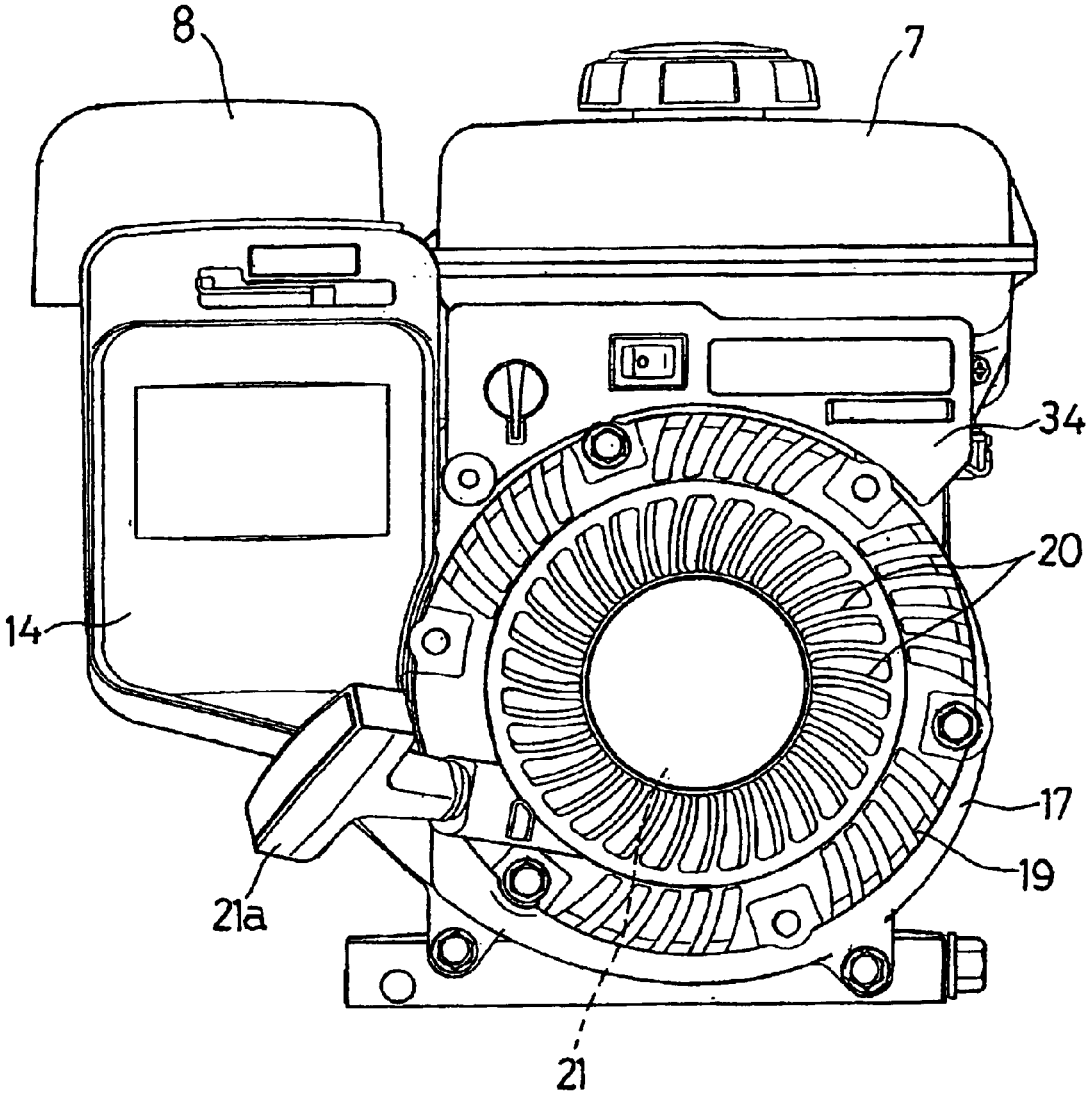
FIG. 2 is a rear view of the small-size engine shown in FIG. 1.

The suction opening is covered by a fan cover 19 having a multiplicity of slotted apertures 20 shown in FIG. 2. A recoil starter 21 having a grip 21*a* is disposed within this fan cover 19 with the grip 21*a* protruding outside of the fan cover 19. An operating panel 34 of the engine is mounted on a rear top portion of the fan housing 17.

Figure 4:
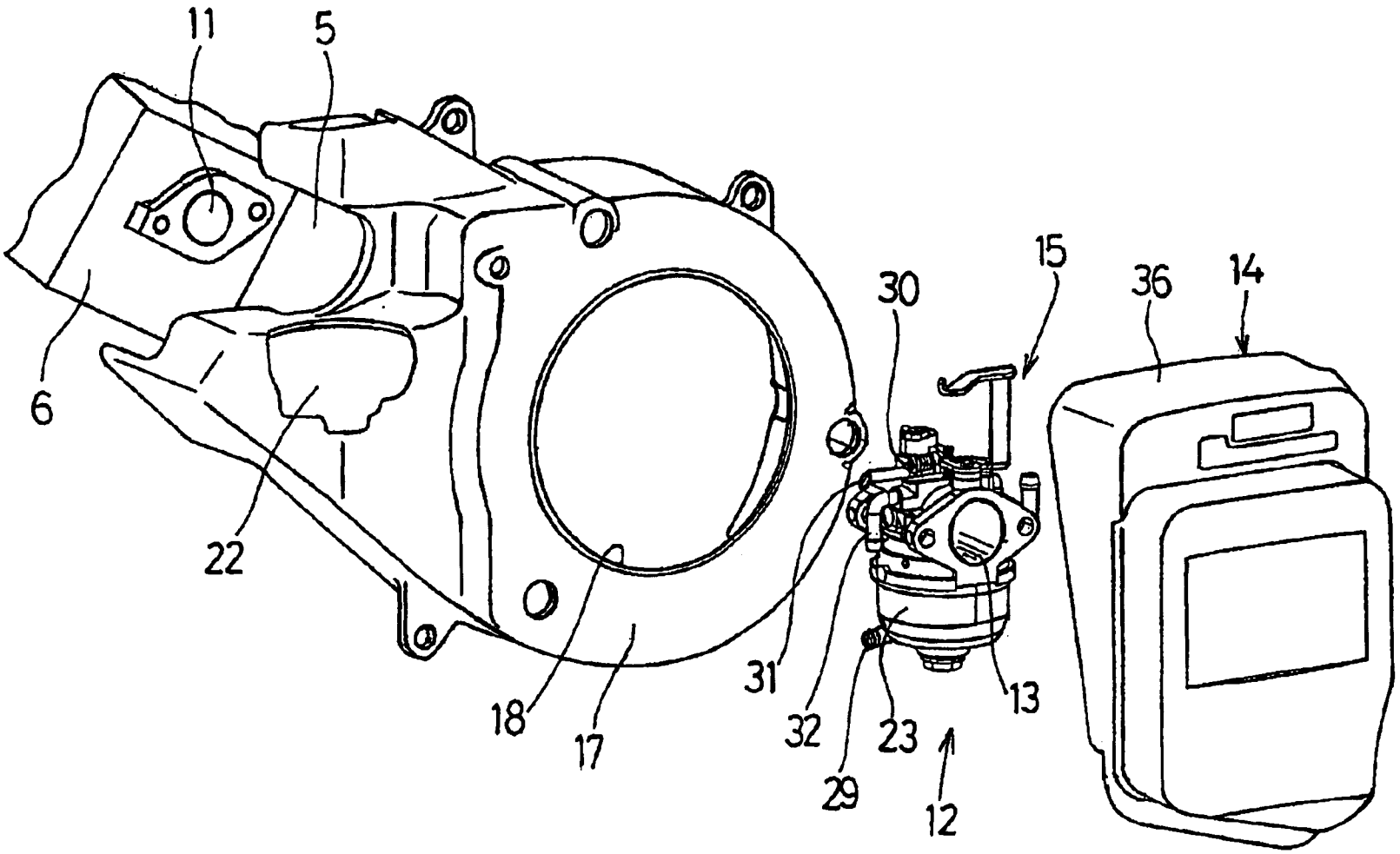
FIG. 4 is an exploded view of the small-size engine, showing the fan housing, a fuel supply device and the air cleaner.

As best shown in FIG. 4, a portion of the fan housing 17 where the fuel supply device 15 is positioned is formed with a cutout 22. Through this cutout 22, as shown in FIG. 5, a major portion of a float chamber 23 of the fuel supply device 15 that is the carburetor is positioned within the fan housing 17. This float chamber 23 is positioned within a portion of a cooling air passage 28, defined by the fan housing 17, and upstream of the cylinder block 5 and the cylinder head 6. As shown in FIG. 4, a drain discharge operating member 29 in the form of a screw member for discharging a fuel drain in the fuel supply device 15, an idling setting member 30 in the form of a screw member for setting the fuel supply unit 15 so that the engine can operate in an idling condition, a pilot setting member 31 in the form of a screw member for supplying a pilot fuel to the fuel supply device 15, an air vent passage 32 for communicating a float chamber 23 of the fuel supply device 15 to the outside to maintain an atmospheric pressure inside the floating chamber 23 and others are exposed to the outside without being covered by the fan housing 17. Accordingly, adjustment of each of the drain discharge operating member 29, the idling setting screw 30 and the pilot setting screw 31 and removal of dusts clogging within the air vent passage 32 can be easily accomplished from outside the fan housing 17.

The air cleaner 14 referred to hereinbefore is fluid connected with an upstream portion of the fuel supply device 15 in the air intake passage and is exposed to the outside of the fan housing or cooling housing 17. As shown in FIG. 1, this air cleaner 14 includes a cleaner element 38 disposed inside a cleaner casing 36.

In the small-size engine having the forced air cooling system of the structure described hereinabove, as shown in FIG. 5, the cooling air W induced by the cooling fan 9 is guided to the cooling air passage 28 in the fan housing 17 and then to the cylinder block 5 and the cylinder head 6 to cool the latter effectively during the operation of the engine.

Particularly in this engine the float chamber 23 of the carburetor 15 which is the fuel supply device is positioned inside the fan housing 17 through the cutout 22 defined in the fan housing 17. Accordingly, as compared with a design in which the carburetor 15 in its entirety is positioned outside the fan housing 17, the carburetor 15 can be positioned at a location close to the engine body 1 and, therefore, the amount of protrusion of the carburetor 15 and the air cleaner 14 coupled with this carburetor 15 that protrude outwardly of the engine body 1 can be reduced, making it possible to assemble the engine in a compact size. In view of this, limitations on the space available for installing the engine to various work units can be minimized correspondingly.

Also, since the float chamber 23 of the carburetor is positioned within the fan housing 17 through the cutout 22, the float chamber 23 is effectively and sufficiently cooled as well by the cooling air W induced by the cooling fan 9 and, therefore, it is possible to avoid irregularity of the engine operation which would result from influences brought about by an external heat, for example, heat from the work units, transmitted to the float chamber 23. Moreover, since the float chamber 23 is positioned within the cooling air passage 28, defined by the fan housing 17, upstream of the cylinder block 5 and the cylinder head 6, the float chamber 23 can be effectively cooled by the cooling air W of a low temperature before the cylinder block 5 and the cylinder head 6 are cooled.

In addition, since the major portion 13*a* of the air intake passage 13 of the air intake system 12 ranging at least from the air cleaner 14 to the downstream end of the fuel supply device 15 is so designed as to extend parallel to the longitudinal axis C of the crankshaft 4, as compared with the conventional case in which it is inclined as shown by the double-dotted line in FIG. 5, the amount of protrusion of the air cleaner 14 and the fuel supply device 15 that protrude laterally and rearwardly (leftwards and downwards as viewed in FIG. 5) from the engine body 1 can be advantageously reduced and, therefore, the limitation on the space available for installation of the engine to the various work units can be alleviated. Yet, as shown in FIG. 3, since the ignition unit 16 for driving the ignition plug is positioned below the fuel supply device 15, the fuel supply device 15 and the ignition unit 16 do not interfere with each other even though the amount of protrusion laterally of the fuel supply device 15 is minimized.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, although in the foregoing embodiment the fan housing 17 has been shown and described as having the cutout 22 formed therein so that the float chamber 23 of the carburetor 15 can be positioned within the fan housing 17, the fan housing 17 may be formed with a recess of a configuration following the contour of the float chamber 23 so that a portion of the float chamber 23 can be accommodated within this recess. In this case, a portion of the fan housing 17 aligned with the recess may have an air guide outlet for allowing the cooling air W to be drawn outwardly so that a portion of the cooling air W can be guided towards the float chamber 23 and its surroundings. It is, however, to be noted that when no cooling of the float chamber 23 is needed, the air guide outlet for the cooling air W may not be formed.

Also, although the fuel supply device 15 has been shown and described as used in the form of a carburetor, a fuel injection device may be employed in place of the carburetor. In such case, the fuel injection device is to be disposed outside the fan housing 17.

Accordingly, such changes and modifications are, unless they depart from the scope of the present invention as delivered from the claims annexed hereto, to be construed as included therein.

What is claimed is:

1. A small-size engine having a forced air cooling system, including a cooling fan mounted on one end of a crankshaft and a longitudinal axis of a cylinder block inclined relative to a horizontal direction and also to a vertical direction so as to be diagonally upwardly oriented, which engine comprises:

a cylinder head mounted atop the cylinder block;

a fan housing for guiding a cooling air, induced by the cooling fan, towards the cylinder block and the cylinder head;

a carburetor including a float chamber; wherein said fan housing has a cutout defined therein, said float chamber of the carburetor being positioned inside the fan housing through the cutout; and an air cleaner fluidly coupled with an upstream portion of the carburetor in an air intake passage, said air cleaner being positioned outside the fan housing.

2. The small-size engine having the forced air cooling system as claimed in claim 1, further comprising an ignition unit for driving an ignition plug of the engine, said ignition unit being positioned within the fan housing at a location below the carburetor.

3. The small-size engine having the forced air cooling system as claimed in claim 1, wherein the float chamber is positioned in a cooling air passage, defined in the fan housing, at a position upstream of the cylinder block and the cylinder head.

4. The small-size engine having the forced air cooling system as claimed in claim 1, further comprising a drain discharge operating member for the carburetor, an idling setting member, a pilot setting member and/or an air vent passage, and wherein at least one of the drain discharge operating member, the idling setting member, the pilot setting member and the air vent passage is positioned outside the fan housing.

5. A small-size engine having a forced air cooling system, including a crankshaft having a longitudinal axis and cooling fan mounted on one end of the crankshaft, and a longitudinal axis of a cylinder block inclined relative to a horizontal direction and also to a vertical direction so as to be diagonally upwardly oriented, which engine comprises:

an air intake passage;

a fuel supply device;

an air cleaner fluidly coupled with an upstream portion of the fuel supply device; and an ignition unit for driving an ignition plug of the engine; wherein a major portion of the air intake passage ranging at least from the air cleaner to a downstream end of the fuel supply device extends parallel to the longitudinal axis of the crankshaft, and wherein the ignition unit is disposed below the fuel supply device.

6. The small-size engine having the forced air cooling system as claimed in claim 5, wherein the fuel supply device is a carburetor having a float chamber, and further comprising:

a cylinder head mounted atop the cylinder block; and a fan housing for guiding a cooling air, induced by the cooling fan, towards the cylinder block and the cylinder head; and wherein said fan housing having a cutout defined therein, said float chamber of the carburetor being positioned inside the fan housing through the cutout.

7. The small-size engine having the forced air cooling system as claimed in claim 6, wherein the air cleaner, fluidly coupled with an upstream portion of the fuel supply, device is positioned outside the fan housing.

8. The small-size engine having the forced air cooling system as claimed in claim 6, further comprising a drain discharge operating member for the fuel supply device, an idling setting member, a pilot setting member and/or an air vent passage, and wherein at least one of the drain discharge operating member, the idling setting member, the pilot setting member and the air vent passage is positioned outside the fan housing.

9. In a combustion engine driven by a source of fuel supplied by a fuel supply device having a cylinder block cooled by external air drawn into a cooling housing adjacent the cylinder block, the improvement comprising:

an opening in the cooling housing of a size to surround a portion of the fuel supply device containing fuel, the fuel supply device positioned within the opening to permit the external air as it is drawn into the cooling housing to contact the portion of the fuel supply device containing fuel to provide a compact configuration and to enable a regular operation of the combustion engine without being influenced by heat from the combustion engine on the supply of fuel;

an air intake passage for the cooling housing;

an air cleaner at an entrance of the air intake passage;

a crankshaft with a longitudinal axis, and a cooling fan mounted on one end of the crankshaft, a major portion of the air intake passage from the air cleaner to the fuel supply device extends approximately parallel to the longitudinal axis of the crankshaft.

10. The combustion engine of claim 9 further comprising an ignition unit for driving an ignition plug mounted on the combustion engine, the fuel supply device is a carburetor and the cooling housing is a fan housing, said ignition unit being positioned within the fan housing at a location below the carburetor.

11. The combustion engine of claim 10 wherein the carburetor portion containing fuel is a float chamber positioned upstream of the cylinder block relative to air drawn into the fan housing.

12. The combustion engine of claim 10 further comprising a drain discharge operating member for the carburetor, an idling setting member, a pilot setting member and/or an air vent passage, and wherein at least one of the drain discharge operating member, the idling setting member, the pilot setting member and the air vent passage is positioned outside the fan housing for operation by a user.

13. The combustion engine of claim 9 wherein the air cleaner is positioned outside the cooling housing.

* * * * *